United States Patent [19]

Taylor

[11] 4,334,647

[45] Jun. 15, 1982

[54] CENTRIFUGES

[75] Inventor: Edward S. Taylor, Lincoln, Mass.

[73] Assignee: Bird Machine Company, Inc., South Walpole, Mass.

[21] Appl. No.: 212,364

[22] Filed: Dec. 3, 1980

[51] Int. Cl.[3] ..... B04B 1/20; B04B 9/10

[52] U.S. Cl. ..... 233/7; 233/23 R

[58] Field of Search ..... 233/7, 23 R, 24, 23 A, 233/19 R, 19 A, 20 A, 1 R, 3, 6

[56] References Cited

U.S. PATENT DOCUMENTS

| | | | |
|---|---|---|---|
| 994,497 | 6/1911 | Berrigan | 233/7 |
| 1,032,285 | 7/1912 | Jahn | 233/7 |
| 2,410,313 | 10/1946 | Strezynski | 233/47 |
| 3,423,016 | 1/1969 | Heckmann | 233/7 |
| 3,428,246 | 2/1969 | Finkelston | 233/7 |
| 3,791,577 | 2/1974 | Lacher | 233/21 |
| 3,862,714 | 1/1975 | Boadway | 233/3 |
| 3,967,778 | 7/1976 | Hunwick | 233/7 |
| 4,085,888 | 4/1978 | Jager | 233/7 |

FOREIGN PATENT DOCUMENTS 876531 11/1942 France .

*Primary Examiner*—Robert W. Jenkins
*Attorney, Agent, or Firm*—Edgar H. Kent

[57] ABSTRACT

A centrifuge includes a power exchange rotor of efficient design which is provided with at least one channel member for guiding the flow of material therethrough from a first end exposed to a source of the material, which is a feed source in a rotor used as a feed accelerator and is material discharging from the bowl treating zone in a rotor used in power recovery. The channel is so formed as to change the direction of flow of the material at least about 90 degrees as it flows therein to a discharge outlet at the other end and is spaced from the rotor axis less than the maximum radius of the bowl in the area of the treating zone. The rotor is mounted for rotation at a rate such that the tangential velocity of the channel ends is substantially less than that of the bowl treating zone. Combined with the rotor is a means for directing transfer of the material between one of the channel ends and the annular pool in the bowl treating zone, approximately tangentially to the surface of the annular pool, while maintaining the kinetic energy of the material substantially unchanged. The rotor used as a feed accelerator is connected to a source of power for rotating it which may include a rotor used for power recovery. The rotor used for power recovery is connected to a means for deriving power from energy imparted to the rotor by the material, which means may be the centrifuge motor shaft or the bowl or other component driven thereby or an electric generator.

43 Claims, 24 Drawing Figures

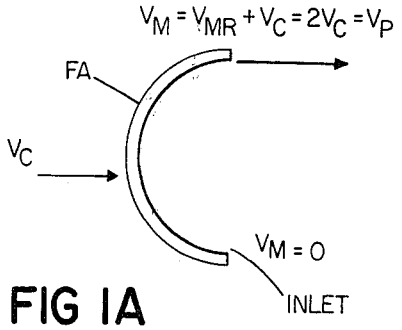
FIG 1A
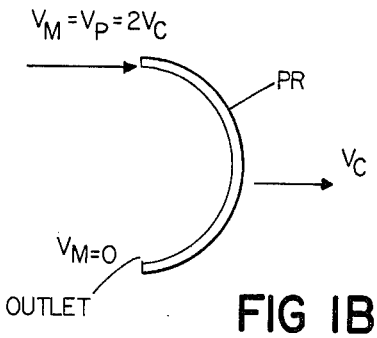
FIG 1B
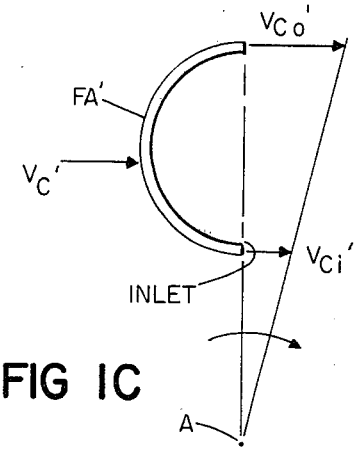
FIG 1C
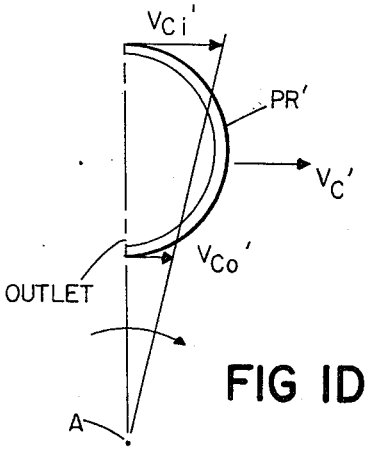
FIG 1D
FIG 2
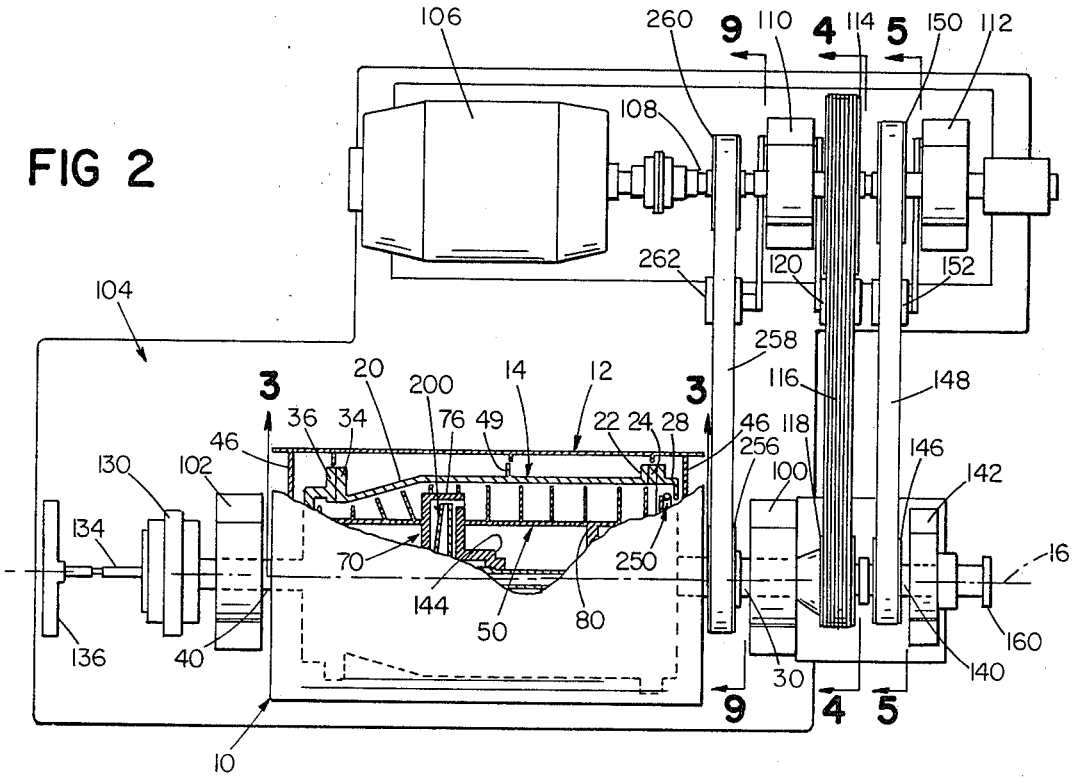

CENTRIFUGES

BACKGROUND OF THE INVENTION

1. Field of the Invention

This invention concerns means and method for reducing waste of power in centrifuges of the type having a rotating bowl in which material flowable as a liquid forms an annular pool and is treated with high centrifugal forces and from which pool such material is discharged while the bowl rotates. More particularly, the invention provides such means and method which can be used to reduce such power waste in either or both reducing the power required to accelerate the material being fed to a treating zone in the outer portion of the bowl to the surface velocity of the pool, and to recover power so applied from the kinetic energy imparted thereby to material discharging from the bowl. While not limited thereto, the invention is particularly described as applied to centrifuges which continuously discharge separately fractions of the material segregating in the bowl, utilizing a conveyor in the discharge of at least one of the fractions.

2. Description of the Prior Art

In feeding material into the outer treating zone of a centrifuge bowl rotating about an axis at high speed, the material must in some way be accelerated to the velocity of the pool surface in the treating zone. The power necessary to effect such acceleration is herein referred to as "hydraulic power", as distinguished from the mechanical power required to rotate the bowl empty, supplying torque necessary to overcome windage and friction losses and to drive the conveyor. If the feed is from a stationary pipe directly into the treating zone, the power for such feed acceleration is imparted thereto directly by rotation of the bowl, and is accompanied by high turbulence and high hydraulic power requirements. Various feed systems have been devised in the prior art to avoid such turbulence, but these have not resulted in major reductions of hydraulic power, which may in many cases constitute 50 percent or more of the total power requirements of the centrifuge.

One such system uses axial feed into a coaxial cone in the bowl with its larger end in or adjacent the treating zone, the feed attaining most of its velocity by frictional slip on the cone surface as it flows outwardly therein to the treating zone. Centrifuges of the rotary helical conveyor type have more usually fed the material from a stationary pipe into the conveyor hub, of smaller diameter than the treating zone of the bowl and rotating in the same direction at a small differential above or below the rate of rotation of the bowl. The partially accelerated feed is then fed to the treating zone from ports in the conveyor hub or, to reduce turbulence, by tubes or vanes providing a flow path to the zone and further accelerating the feed.

In such prior art systems all of the requisite acceleration of the feed is effected either by the bowl or by additional mechanism rotated about the bowl axis at, or substantially at, bowl speed and at low efficiency.

Various suggestions in the prior art for recovering power from the kinetic energy of material discharging from the bowl have not been suitable for, or considered sufficiently effective for, general adoption, and the practical art has continued for the most part to waste such kinetic energy by discharging the material directly to stationary receivers. Such prior art suggestions include the following.

U.S. Pat. No. 1,032,285 of 1912 and French Patent No. 876,531 of 1942 disclose centrifuges in which a liquid fraction is discharged through curved passages extending generally away from the bowl axis. Although the arrangement is intended to recover power by converting kinetic energy in the discharging material into usable shaft power applied to the bowl, net power recovery, if any, would be small, since extra power would have to be applied to the bowl to cause flow outwardly of the axis through the passages. Similarly, U.S. Pat. No. 3,791,577 of 1974 discloses a centrifuge in which a solid slurry fraction is discharged from the bowl end over a wide lip extending away from the bowl axis, from which lip it is ejected away from the bowl axis against curved baffle plates on a separately driven rotor having a different axis. Here, again, bowl rotation power required to be added to force the material away from the bowl axis would drastically reduce any net power savings from the arrangement, the stated purpose of which is to reduce product degradation, not to recover power.

U.S. Pat. No. 3,862,714 of 1975 discloses a centrifuge in a conical end provided with straight vanes, rotating with the bowl, which form with the bowl end straight passages that slant inwardly toward the bowl axis, through which the liquid fraction passes to an axial outlet near the apex of the conical part. The patent states that the liquid gives up acquired angular momentum to the vanes and to that extend reduces power requirements for rotating the bowl. The arrangement appears limited in use to the particular type of centrifuge disclosed in the patent, which is operated with the bowl full and with a forced vortex.

Yet another system proposed in the prior art relies on jetting liquid out holes in the bowl wall, as exemplified by U.S. Pat. No. 2,410,313 of 1946. Apart from adding undesirable complexity to bowl construction for what could at best be power recovery from only a small portion of the liquid, and difficulties of plugging of the necessarily small outlets with solids, the system is handicapped by inability to discharge the jets in the most effective tangential direction, for practical reasons set forth in said U.S. Pat. No. 2,410,313.

SUMMARY OF THE INVENTION

An object of this invention is to provide means and method for reducing power waste in centrifuges which are more effective than those that have been suggested in the prior art, and are generally applicable to centrifuges of the type concerned.

Another object is to provide such means and method whereby the feed material may be pre-accelerated and fed to the treating zone of the bowl, substantially tangentially to the path of rotation of the inner surface of the zone, at a tangential velocity substantially equal to the tangential component of velocity of the inner surface of said zone, with significantly reduced turbulence and with lower power requirements than those of prior feed systems.

A further object is to provide such means and method whereby kinetic energy in treated material discharging from the bowl may be recovered as useful power more effectively than in power recovery systems suggested in the prior art.

In attaining the foregoing objects, the invention utilizes a power exchange rotor of efficient design mounted for rotation about an axis, which is preferably the bowl axis. The rotor is provided with at least one channel member for guiding the flow of material therethrough from a first end exposed to a source of the material, which is a feed source in a rotor used as a feed accelerator and is material discharging from the bowl treating zone in a rotor used in power recovery. The channel is so formed as to change the direction of flow of the material at least about 90 degrees as it flows therein to a discharge outlet at the other end and is spaced from the rotor axis less than the maximum radius of the bowl in the area of the treating zone. The rotor is constructed and arranged to rotate at a rate such that the tangential velocity of the channel ends is substantially less than that of the bowl treating zone.

Combined with the rotor is a means for directing transfer of the material between one of the channel ends and the annular pool in the bowl treating zone, approximately tangentially to the surface of the annular pool, while maintaining the kinetic energy of the material substantially unchanged. The rotor used as a feed accelerator is connected to a source of power for rotating it which may include a rotor used for power recovery. The rotor used for power recovery is connected to a means for deriving power from energy imparted to the rotor by the material, which means may be the centrifuge motor shaft or the bowl or other component driven thereby or an electric generator.

In either case, the efficiency of the rotor in transferring energy between the rotor and the material is preferably made as high as practicable by reducing friction and windage losses, so that at least about 70 percent and preferably more of the kinetic energy available in the one is transferred to the other. Used as a feed accelerator, where the discharge end of the rotor channel or channels are outermost, such efficiency means that the feed material will discharge from the rotor at a tangential velocity of at least 1.4 times the velocity of the discharge ends, two times being the theoretical maximum (no losses). As a consequence, the rotor can be rotated at a much lower peripheral velocity than the bowl while yet accelerating the feed to a tangential velocity equal to or somewhat above the tangential component of velocity of the material at the inner surface of the pool in the bowl treating zone, for transfer to the zone at such tangential velocity with little or no loss of power due to turbulence. Thus substantial power is saved over less efficient feed acceleration systems of the prior art, saving of as much as a third of the hydraulic power required for acceleration by conventional systems feeding through the conveyor hub of a conveyor type centrifuge.

In the case of the rotor used for power recovery, such efficiency means that kinetic energy is released by the material at such rate that power is imparted to the rotor shaft equal at least to 70 percent of the power available in the kinetic energy of the material, this being recovered as usable power by connecting the rotor as indicated above. Hence by using power exchange rotors with transfer means in both centrifuge feed and discharge systems, savings of as much as 60 percent or more of the total hydraulic power previously required for operation of the centrifuge may be effected.

In preferred embodiments the channel members change the direction of flow of the material about 180 degrees from inlet end to outlet end.

In one embodiment of the rotor used as a feed accelerator, the rotor diameter is only slightly less than that of the inner surface of the bowl treating zone, and the transfer means for directing the rotor discharge into the bowl treating zone is a tangentially directed outlet end from each channel of the rotor. Due to the close proximity of these outlets to the inner surface of the treating zone there is small loss of velocity in the transfer. In another such embodiment, which may be advantageously used in centrifuges having rotary conveyors, the accelerator rotor is of smaller diameter than the inner surface of the bowl treating zone and is attached to the conveyor to be rotated thereby at a small differential to bowl r.p.m. but at much lower peripheral velocity than the bowl because of its smaller diameter. The transfer means for directing the rotor discharge into the bowl treating zone is in the form of an array of curved stator channels surrounding the rotor discharge area, receiving the material discharged from the rotor at one end and conducting it outwardly in the direction of rotation to discharge ends located in close proximity to the inner surface of the bowl treating zone and arranged to discharge tangentially thereto. The power required to drive the rotor is much less than the power required by the feed arrangements of the prior art as above discussed. The stator channels are designed to minimize friction losses. The embodiment has advantages in simplification of equipment due to avoidance of extra drive equipment for the rotor when attached to a centrifuge conveyor.

In cases in which the feed material is supplied to an accelerator rotor under substantial pressure, such rotor can utilize that pressure both by converting it to increased kinetic energy in the material over that induced by rotation of the rotor and by utilizing it as a rotary driving force on the rotor itself, effecting proportionate further reductions in hydraulic power requirements.

In a preferred embodiment of a rotor used for power recovery, the rotor is mounted for rotation about the bowl axis independently of the bowl, and is of a diameter such that the inlet ends of the channel members of the rotor dip into the annular pool of material in an overflow gutter at one end of the bowl for receiving material overflowing thereto from the treating zone. The transfer means comprises, in addition to the gutter, inlet ends of rotor channel members arranged opposite to the direction of rotation of the bowl and pool so that the material is forced to flow tangentially into them from the material annulus in the gutter. The rotating channel members of the rotor provide flow paths of about 180 degrees change of direction approaching the bowl axis in substantial part to outlets near the bowl axis, thereby converting kinetic energy of the material flowing out of the bowl into power which is available from the rotor shaft. The rotor operates at a lower peripheral velocity than that of the pool surface. The rotor is connected to provide power directly to the main drive shaft of the centrifuge, but may be otherwise connected as indicated earlier.

In another preferred embodiment of the rotor used for power recovery, the rotor is fixed co-axially to the bowl and is of considerably smaller diameter than the bowl, desirably slightly less than half the bowl diameter, so that its peripheral velocity is correspondingly less than that of the bowl. The transfer means again comprises an annular overflow gutter for material from the treating zone, and includes a stator comprising one or more fixed transfer members having a scoop inlet end arranged to dip substantially tangentially into the annulus of material in the gutter, an outlet end arranged to discharge the material into the inlet ends of channel members of the rotor substantially tangentially to their path of rotation, and an intermediate flow channel designed to conduct the material to the transfer member outlet in a low friction path, in which the material retains its kinetic energy and velocity substantially unchanged (minor friction losses only). The channel members provide semi-circular concavities into one end of which the material is directed and from the other end of which it discharges. The energy available from the rotor is nearly that required to accelerate material to pool surface velocity.

While the power recovery mechanism of both embodiments could be contained in the bowl, with the rotor or stator dipping directly into the pool of liquid in the treating zone, external location permitted by the gutter is preferred to avoid turbulence in the pool and for ease of access. It is preferred where feasible to use two of the rotors, one in feed acceleration and the other in power recovery mode.

Other features and advantages of the invention will be seen as the following description of particular embodiments progresses, in conjunction with the drawings, in which:

FIGS. 1A–D are diagrams illustrating, in principle, power exchange rotor action in accordance with the invention;

FIG. 2 is a plan view of a centrifuge system in accordance with the invention;

DESCRIPTION OF THE PREFERRED EMBODIMENTS

Figure 3:
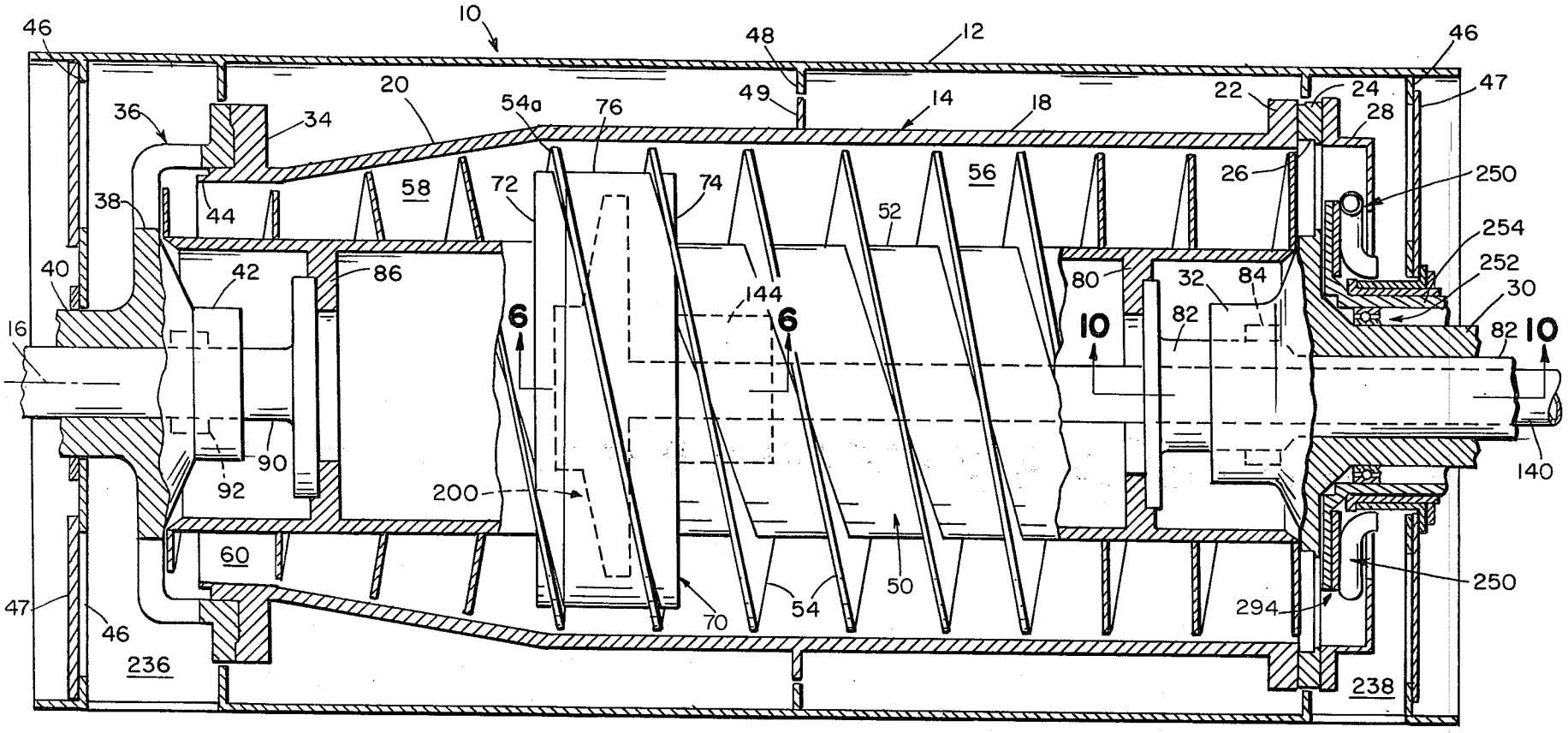
FIG. 3 is a sectional view taken generally along the line 3—3 of FIG. 2, showing further details of the centrifuge of FIG. 2.

Referring first to the diagrams of FIGS. 1A and B, these illustrate in principle and idealized manner how power exchange takes place in rotors utilized in the invention, from rotor to material in rotors used as feed accelerators (FIG. 1A) and from material to rotor in rotors used for power recovery (FIG. 1B). In the diagram of FIG. 1A, feed accelerator channel member FA (of semi-circular form and 180 degrees in angular extent) is mounted on a feed accelerator rotor that is rotated counterclockwise about a vertical axis behind the drawing at a channel velocity $V_C$ as driven by an external power source; and in the diagram of FIG. 1B, power recovery channel member PR (of like form) is mounted on a power recovery rotor that is rotating in the same direction about a vertical axis behind the drawing to provide the same channel velocity $V_C$.

In FIG. 1A, the leading side of channel FA is concave and feed material M is applied at assumed zero velocity ($V_M=0$) to the inlet end of channel FA. Since the channel itself is moving with the velocity $V_C$ and the material is stationary (at inlet) the velocity of the material relative to the channel is equal and opposite to $V_C$ or $V_{MR}=-V_C$. The magnitude, but not the direction of this relative velocity is maintained to the exit of the channel. Since the channel reverses the direction of the relative velocity, the velocity at exit is given by $V_M=V_{MR}+V_C=2V_C$. With the channel outlet positioned immediately adjacent the surface of the centrifuge pool, the channel velocity $V_C$ is one-half the velocity ($V_P$) of the pool surface.

Reversely, as indicated in FIG. 1B, the trailing side of power recovery rotor channel member PR is concave and material M from the pool surface is applied tangentially to the inlet end of the channel PR essentially at the velocity of the centrifuge pool surface (such velocity being indicated by the vector $V_P$). Channel PR is driven at a velocity one-half $V_P$ either by the power exchange or by an arrangement in which the rotor feeds back power to the centrifuge. In this case, the relative velocity of the material entering the rotor is given by $V_{MR}+V_C=V_M$ and since $V_C=V_P/2=V_M/2$, the relative velocity is also $V_P/2$. Again the 180 degree change in the direction of the relative velocity reverses the sign of $V_{MR}$ but its magnitude remains unchanged so that, at the exit from the rotor the absolute velocity of the material is zero $-V_{MR}+V_C=0$.

Where the rotor axis A of rotation is perpendicular to the drawing as indicated in FIGS. 1C and 1D, the actual velocities of the channel ends differ in proportion to their relative distances from the rotor axis A, that is, $V'_{Ci}$ is less than $V'_{Co}$ in channel FA', and $V'_{Ci}$ is greater than $V'_{Co}$ in channel PR'. In this case the magnitude of the relative velocity is proportional to the radius at which the velocity is measured.

If the power exchange systems indicated in FIGS. 1A–D were 100 percent efficient, the power recovery rotor could be coupled to drive the feed accelerator rotor with both rotating at half the angular velocity of the centrifuge bowl, no external source of power being necessary. There must be flow through the rotor in a direction perpendicular to the motion of a channel. For this reason the angle of turn of the channel must usually be somewhat less than 180 degrees. Allowance is also made for the effect of friction between the material and the directing walls and windage in the rotors, minimizing these to the extent feasible and at least to bring the power exchange efficiencies of the rotors to the 70 percent or higher range. The result of such allowance is that the velocity of the passages at outlet from the accelerator will be more than one-half of the desired discharge velocity. Conversely the inlet velocity of the power recovery passages will be somewhat less than one-half of the pool velocity. Channel shape and angular extent, rotor diameters and channel velocity values are interrelated and may be varied as appropriate in particular applications.

An accelerator rotor channel of shape as assumed for FIGS. 1A or C is preferably designed for rotation at a tip speed of more than half the peripheral velocity of the centrifuge bowl such as required to offset losses and make the material discharge velocity at least equal to the velocity of the pool surface in the treating zone in the bowl, higher if necessary to offset losses of velocity in transfer of the material from rotor to treating zone. Similarly, a power recovery rotor channel of shape as assumed for FIGS. 1B or D is preferably designed for rotation at a tip speed of less than half of the peripheral velocity of the centrifuge bowl. Thus some external power is needed to rotate the feed accelerator rotor even when it is used in combination with a power recovery rotor.

Describing now the embodiments illustrated in the remaining Figures of the drawing, reference will first be had generally to FIG. 2 which shows, in partially broken away plan view, a centrifuge of the solids-liquid separating type with conveyor, together with motor and drive connections, in which have been incorporated one form of a power exchange rotor and transfer means assembly operating as a feed material acceleration system and another form of such assembly operating to recover power from the discharging material and to feed this power back to the drive motor shaft, as shown in further details in FIGS. 3–13.

With reference to FIGS. 2 and 3, the centrifuge, designated generally by the reference numeral 10, has a housing 12 in which centrifuge bowl 14 is mounted for rotation about centrifuge axis 16. Bowl 14 has a length of about fifty-five inches; and includes a cylindrical section 18 that has an inner diameter of about twenty-four inches and a length of about 37½ inches, and a conical section 20 that has a length of about 11½ inches and tapers at an angle of 10° to the centrifuge axis 16. Bolted to bowl flange 22 is liquids end bowl head 24 which has four liquid discharge openings 26 and an integral shaft portion 30 and an integral bearing housing 32. Circumferential gutter 28 is bolted to and rotates with bowl head 24. Bolted to flange 34 at the opposite end of bowl 14 is a solids end bowl head 36 that has openings 38 through which solids are discharged and an integral shaft portion 40 and an integral bearing housing 42. Cylindrical weir 44 is also bolted to and rotates with bowl 14. Housing 12 has end plates 46 which carry hand hole covers 47 and baffles 48 which cooperate with corresponding flanges 49 on bowl 14.

Mounted within bowl 14 for rotation about centrifuge axis 16 is conveyor 50 that includes a cylindrical hub 52 of about fourteen inches outer diameter and outwardly projecting helical vane flights 54 axially spaced 4½ inches apart on center in a double lead arrangement. The conveyor vanes 54 have a first cylindrical section 56 that cooperates with cylindrical bowl section 18, a first frusto-conical section 58 that tapers at a ten degree angle over a length of about 11½ inches and cooperates with bowl section 20; and a second frusto-conical section 60 that tapers at a three degree angle and extends beyond flange 34 into bowl head 36. Formed integrally with hub 52 is a feed acceleration chamber 70 which has side wall 72 located at the junction between conveyor sections 56 and 58, side wall 74 spaced from wall 72 so that their inner surfaces are spaced 4½ inches apart, and a cylindrical wall 76 that has an inner diameter of about twenty inches to the outer surface of which conveyor flights **54*a* are attached. Conveyor hub 52 has an interior flange 80 to which is bolted hollow conveyor shaft 82, which is supported for rotation within bearing housing 32 by bearing and seal assembly 84; and secured to similar conveyor hub flange 86 is a second conveyor shaft 90 that is supported for rotation by bearing and seal assembly 92 within bearing housing 42**.

Figure 4:
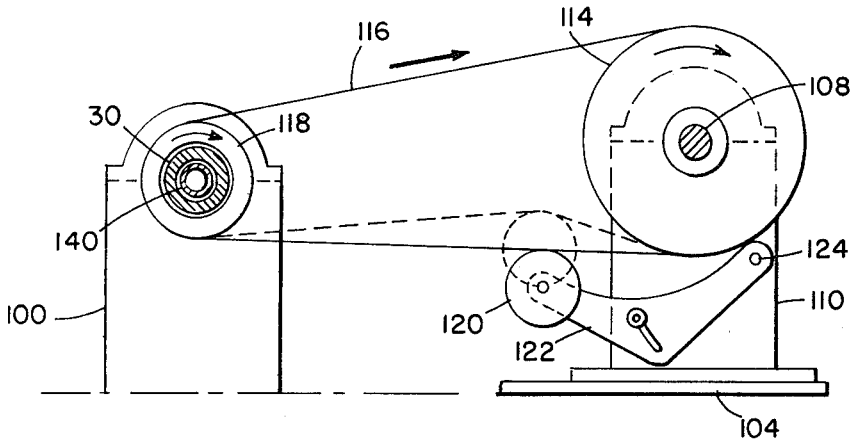
FIG. 4 is a diagrammatic view, taken along the line 4—4 of FIG. 2, showing aspects of the centrifuge bowl drive arrangement.

As indicated in FIG. 2 bowl shafts 30 and 40 are supported for rotation about centrifuge axis 16 by roller bearing assemblies in pillow block bearing supports 100, 102 which are mounted on base 104. Mounted on the same base structure 104 as bearing supports 100, 102 is a one hundred horsepower drive motor 106 which rotates drive shaft 108 that is supported for rotation by bearing assemblies in pillow block bearing supports 110, 112. Drive sheave 114 is coupled to and driven by motor shaft 108 and driving power is transmitted via six V-belts 116 to driven sheave 118 that is fixed to bowl shaft 30. As indicated in FIG. 4, belts 116 are tensioned by idler roller 120 that is mounted for rotation at the end of bracket arm 122, arm 122 in turn being mounted on pivot shaft 124. Drive sheave 114 is driven at 1750 r.p.m. by drive shaft 108. Driven sheave 118 has one-half the pitch diameter of sheave 114 and thus is driven at 3500 r.p.m. by motor 106. Shaft 40 at the other end of bowl 14 extends through bearing support 102 (FIG. 2) and is fixed to the casing of speed change gear box 130, the gearing whereof (not shown) is connected via a spline connection to conveyor shaft 90 within shaft 40 to rotate conveyor hub 52 and its vanes 54 in the same direction as bowl 14 at a small r.p.m. differential to bowl speed, in this instance at slightly lower r.p.m. A shear pin shaft 134 fixed to a pinion in gear box 130 and at the other end to fixed support 136 serves to hold the pinion in gear box 130 from rotation, providing torque overload protection.

Figure 5:
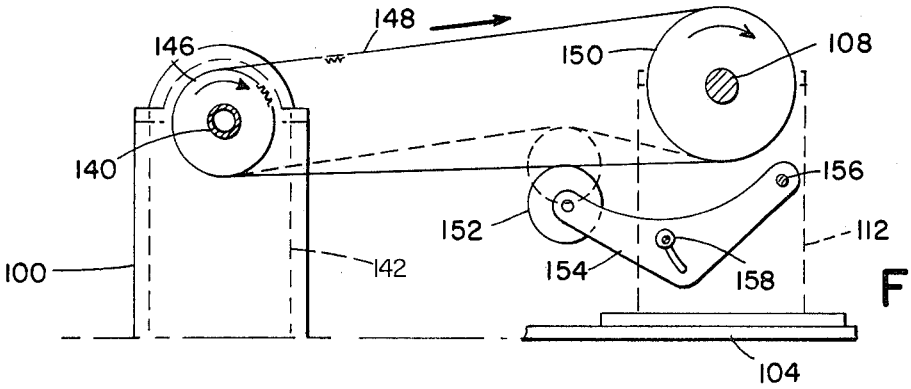
FIG. 5 is a diagrammatic view, taken along the line 5—5 of FIG. 2, showing aspects of the power exchange feed accelerator drive arrangement.

Feed pipe 140 (FIG. 3) is supported within conveyor shaft 82 for rotation about centrifuge axis 16 by bearings in auxiliary outboard support assembly 142 (FIG. 2) and at the other end by a ball bearing and seal assembly in bearing housing 144 that is secured to wall 74 of feed accelerator chamber 70. Secured in driving relation on feed pipe 140 is toothed pulley 146 that is positively driven by timing belt 148 and toothed drive pulley 150 that is secured to drive shaft 108. As indicated in FIG. 5, a belt tensioning arrangement, similar to the main drive belt tension arrangement shown in FIG. 4, includes idler 152 supported for rotation on bracket 154 which in turn is mounted for pivoting movement on shaft 156 and is secured in belt tensioning position (as indicated in dash line) by lock nut 158. The relative pitch diameters of pulleys 146 and 150 are selected such that feed pipe 140 is driven at 2490 r.p.m.

With reference again to FIG. 2, coupling 160 at the end of feed pipe 140 is arranged for connection to feed material supply piping (not shown). Coupling 160 provides a flow passage that tapers inwardly towards the centrifuge 10 and rotary feed pipe 140 has a mating enlarged portion at its inlet end which provides flow communication with fixed coupling 160. The process feed stream, a mixture of solids and liquid, is delivered in the form of a slurry and flows through feed pipe 140 to acceleration chamber 70.

Figure 7:
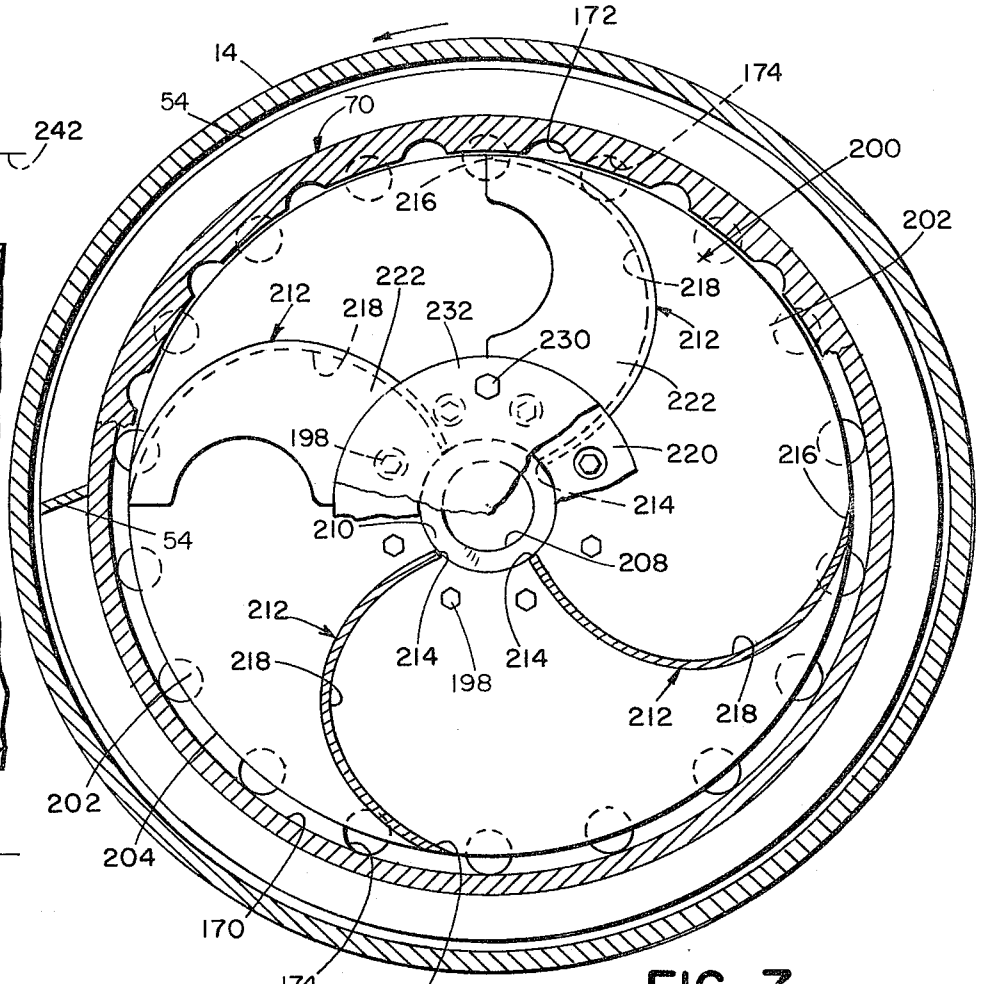
FIG. 7 is a sectional view taken along the line 7—7 of FIG. 6.
Figure 6:
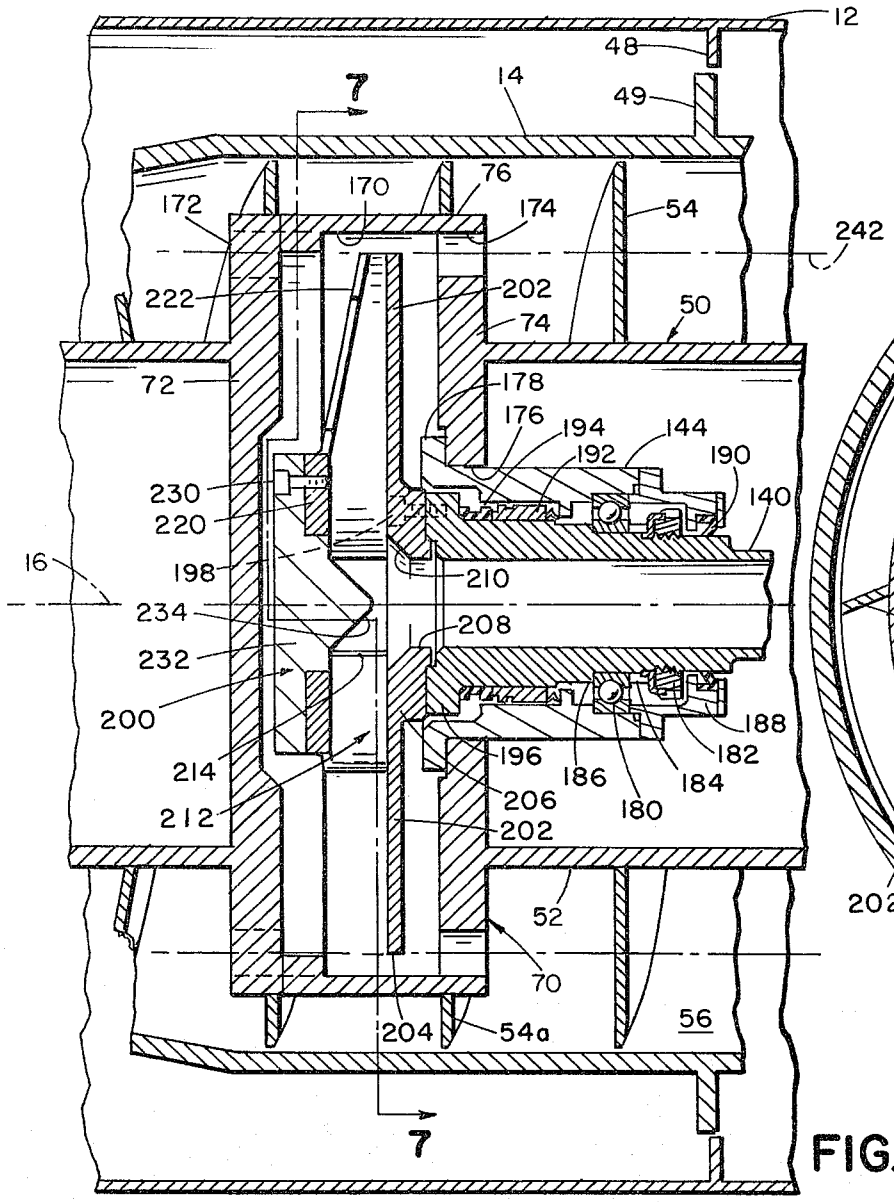
FIG. 6 is a sectional view taken along the line 6—6 of FIG. 3.

Further details of the feed acceleration system may be seen with reference to FIGS. 6 and 7. As indicated above, the opposed surfaces of walls 72 and 74 of feed acceleration chamber 70 are spaced 4½ inches apart and annular surface 170 has an inner diameter of about twenty inches. Formed in wall 72 is a circumferential array of eighteen ports 172, each port having a diameter of 1½ inch and being tangential with surface 170. A similar circumferential array of eighteen ports 174 are provided in wall 74 of the accelerator chamber.

Formed in accelerator chamber wall 74 is opening 176 in which flange 178 of bearing housing 144 is bolted. Disposed within bearing housing 144 is a ball bearing assembly 180 which supports feed pipe 140 for rotation. Lock nut 182 and spacer 184 seat bearing assembly 180 against feed pipe shoulder 186. Bearing cap 188 is bolted to the end of bearing housing 144 and ring seal elements 190, 192, 194 seal the ends of the bearing housing.

Bolted to flange 196 of feed pipe 140 (by bolts 198, FIG. 7) is an energy exchange feed accelerator rotor assembly 200 that includes an annular base plate 202 with an outer diameter of about nineteen inches such that its peripheral surface 204 is spaced about ½ inch from accelerator chamber surface 170. Base plate 202 has a hub portion 206 which defines entrance port 208 and throat surface 210. Welded to base plate 202 is an array of four upstanding, semicircular acceleration vanes 212, each of which has an entrance edge 214 that merges with surface 210, a discharge edge 216 at the periphery 204 of rotor disc 202, and a smoothly curved surface 218 that extends along a four inch radius over an angular extent of about 150 degrees. Seated on and welded to the inner portions of vanes 212 is plate 220 that has an outer diameter of eight inches; such that an annular vane inlet channel about 1½ inch wide is defined between parallel surfaces of base disc 202 and plate 220. Overlying each vane 212 outwardly of plate 220 is a shroud 222 that is inclined at an angle of about ten degrees so that a vane discharge region of about ½ inch width is provided. Secured to plate 220 by bolts 230 is a cover member 232 that has a conical deflector surface 234 in opposed alignment with the entrance port 208 of the acceleration rotor for deflecting feed stock fed from feed pipe 140 radially outward into the inlet channel region of vanes 212.

In operation, as described above, bowl 14 is driven in rotation at 3500 r.p.m., and slurry in the bowl forms an annular pool 240 against the inner surface of bowl 14 with a pool surface indicated by line 242 which defines the inner surface of the treating zone of the bowl. As is usual with centrifuges of this type, differential rotation of centrifuge bowl 14 and conveyor 50 causes the conveyor vanes 54 to advance continually the solids settling towards the bowl from material fed thereto, to and out the reduced diameter left-hand end of the bowl through openings 38 in bowl head 36 into a discharge compartment 236 in housing 12 while the liquid flows through ports 26 in bowl head 24 into gutter 28 in discharge compartment 238 at the other end of housing 12.

Figure 8:
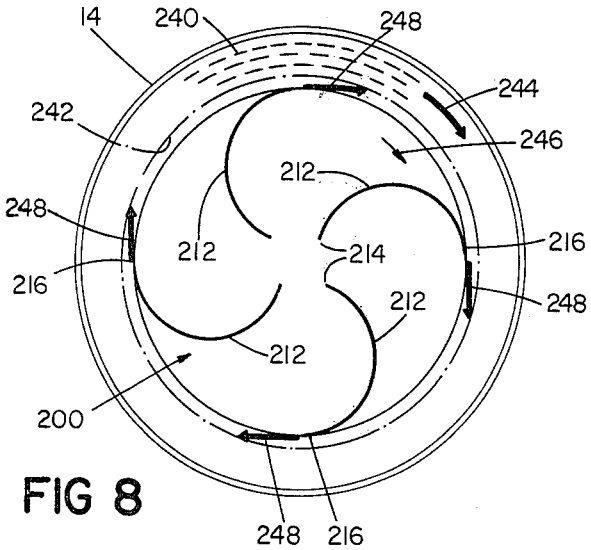
FIG. 8 is a diagrammatic view illustrating operation of the power exchange feed accelerator rotor system employed in the centrifuge shown in FIGS. 2 and 3.

The centrifuge is arranged so that outer wall 76 of acceleration chamber 70 is beneath the surface 242 of pool 240, and is rotating at substantially the same angular velocity as the pool (diagrammatically indicated by arrow 244 in FIG. 8). Feed accelerator rotor 200 is positively driven at 2490 r.p.m. (arrow 246) via drive pulley 146 and feed pipe 140, and the slurry fed from feed pipe 140 flows radially outwardly into the annular rotor entrance region between plates 202 and 220. The feed slurry is accelerated by the channel members formed by vanes 212, plates 202 and 222 along vane surfaces 218 and acquires increasing velocity as it flows along vane surfaces 218 towards vane tips 216. The chamber 70 of the feed acceleration rotor 200 prevents pumping of the large volume of air in the bowl as rotor 200 would otherwise try to do, and minimizes pool disturbances and aeration of effluent, and thus increases power exchange efficiency.

As indicated in the diagram of FIG. 8, the vane tips 216 are shaped to discharge the accelerated slurry essentially tangentially to their path of rotation and to the path of rotation of pool surface 242 at a velocity (arrows 248) substantially the same as the velocity of the pool surface 242 about bowl axis 16 for smooth integration tangentially into pool 240 with minimal turbulence. Thus the vane tips function to transfer the slurry between rotor and pool substantially tangentially to both. Material in the pool 240 in chamber 70 flows axially through ports 172, 174 into bowl 14 for treatment by high centrifugal forces with solids being conveyed axially through pool 240 to weir 44 by conveyor 50.

Figure 9:
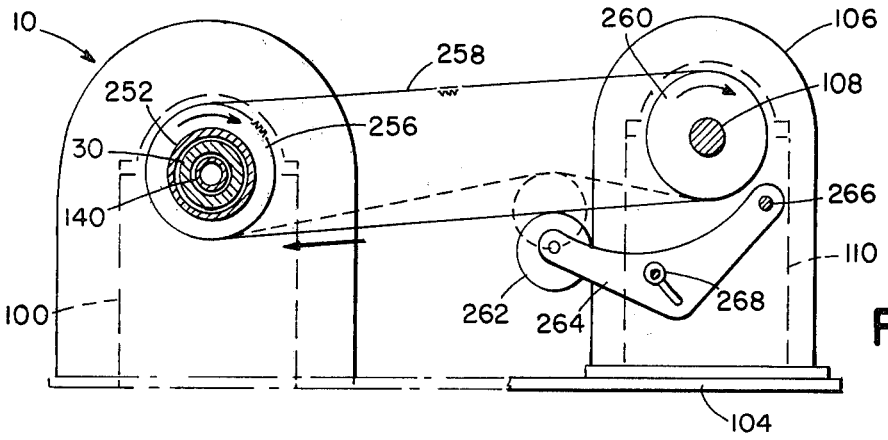
FIG. 9 is a diagrammatic view taken along the line 9—9 of FIG. 2, showing aspects of the drive arrangement of the power recovery system employed in the centrifuge shown in FIGS. 2 and 3.

With reference again to FIGS. 2 and 3, disposed in chamber 238 is a power recovery system that includes a power recovery rotor assembly 250. Rotor assembly 250 is supported for rotation on bowl shaft 30 by bearing assembly 252 and includes shaft portion 254 to which toothed pulley 256 is bolted. As indicated in FIG. 2, pulley 256 is connected by timing belt 258 to pulley 260 that is mounted on the motor drive shaft 108. As indicated in FIG. 9, a belt tensioning arrangement, similar to the main drive belt tension arrangement shown in FIG. 4, includes idler 262 supported for rotation on bracket 264 which in turn is mounted for pivoting movement on shaft 266 and is secured in belt tensioning position (as indicated in dash line) by lock nut 268. The relative pitch diameters of pulleys 256 and 260 are selected such that power recovery rotor 250 is driven at 1586 r.p.m.

Figure 11:
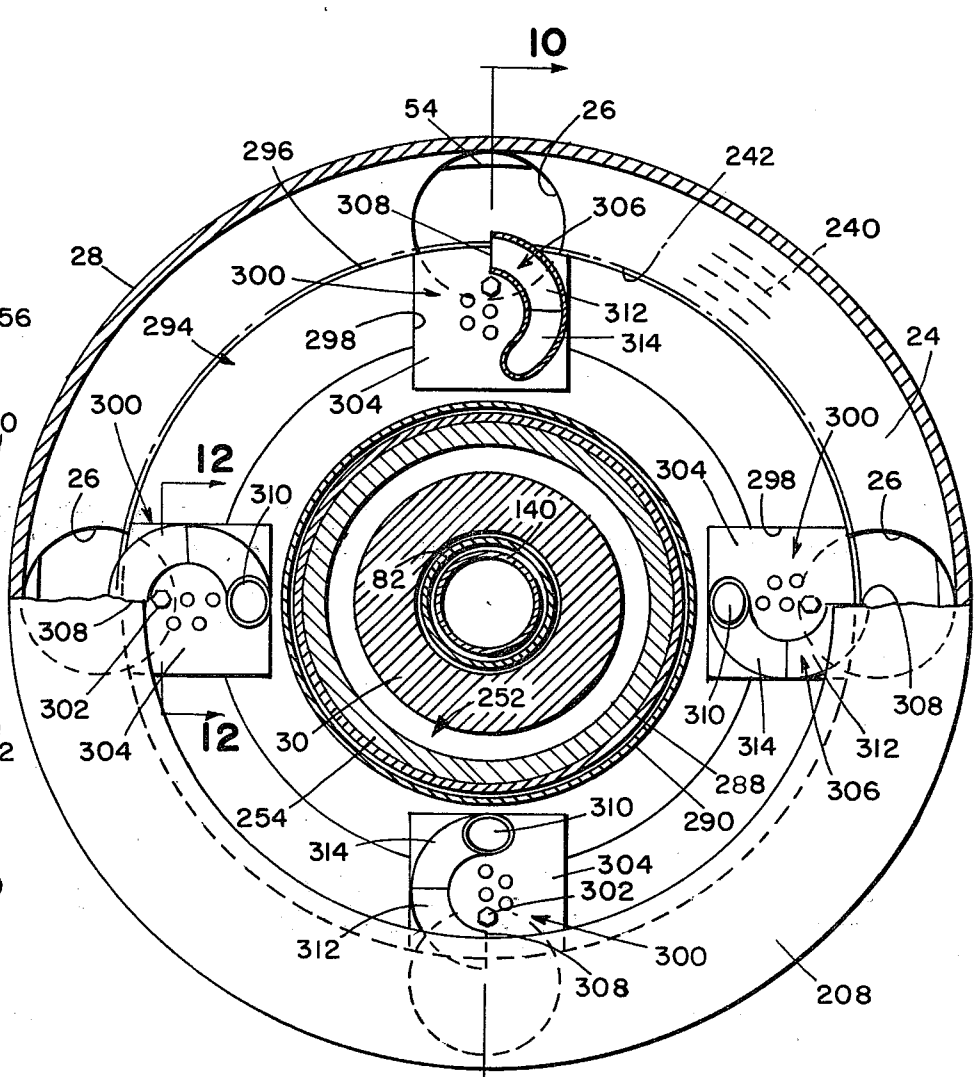
FIG. 11 is a sectional view taken along the line 11—11 of FIG. 10.
Figure 10:
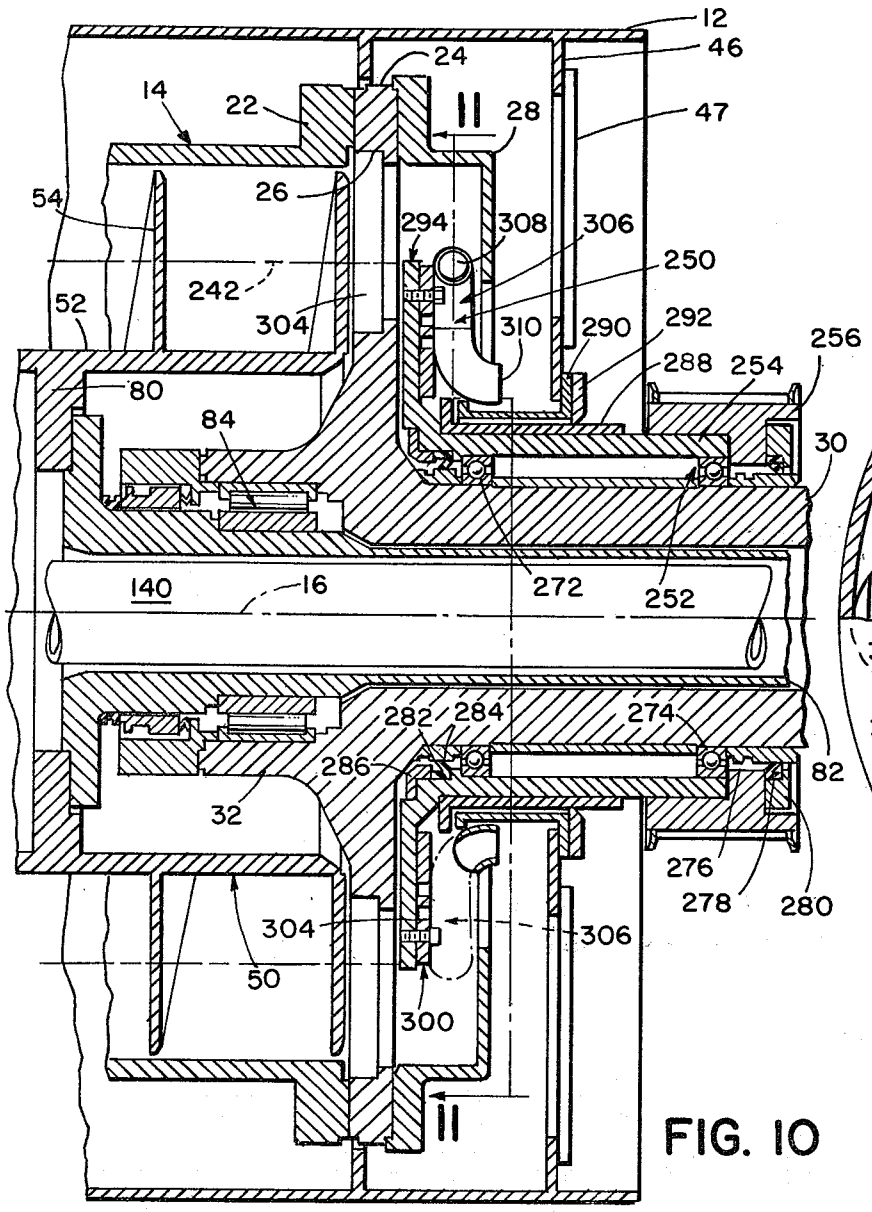
FIG. 10 is a sectional view taken generally along the line 10—10 of FIG. 3.

Further details of the power recovery rotor assembly may be seen with reference to FIGS. 10 and 11. Bearing assembly 252 includes two ball bearing units 272, 274 that are mounted within rotor shaft 254. Seals 276 and 278 and cover 280 enclose and seal the outer end of the bearing assembly; and seals 282, 284 and cover 286 enclose and seal the inner end of the bearing assembly adjacent ball bearing unit 272. Carried by shaft 254 for rotation therewith is flinger 288; and secured to end wall 46 of casing 12 is a baffle ring 290 that carries seal member 292 that engages flinger 288.

Figure 12:
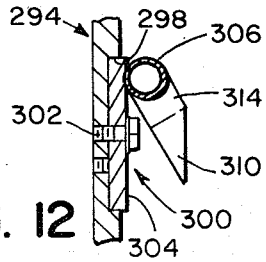
FIG. 12 is a sectional view of a rotor channel member assembly taken along the line 12—12 of FIG. 11.
Figure 13:
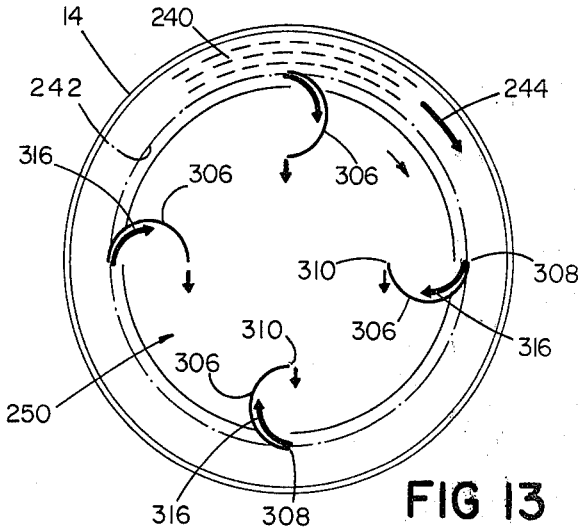
FIG. 13 is a diagrammatic view, similar to FIG. 8, illustrating operation of the power recovery arrangement employed in the centrifuge shown in FIGS. 2 and 3.

The power recovery rotor assembly 250 includes radially disposed disc 294 that extends into the pool area between liquids end bowl head 24 and gutter 28. Disc 294 has a diameter of nineteen inches and a rim region 296 in which are formed four radially extending recesses 298. A rotor channel member assembly 300 is secured in each recess by a bolt 302. Each assembly 300 includes a base plate 304 on which is welded a tubular discharge channel 306 that has a cylindrical entrance port 308 disposed normal to surface 242 of pool 240 and a discharge port 310 disposed in a plane perpendicular to entrance port 308. Each discharge channel 306 has a diameter of about one inch and a radial length of about four inches, and, as shown in FIGS. 11 and 12, extends from entrance port 308 through a first 90 degree turn section 312 and a second 90 degree turn section 314 to discharge port 310 that is located for discharge at an angle of about 45 degrees to centrifuge axis 16. The radial location of each entrance port 308 is adjustable and each port 308 is positioned so that it is partially submerged in pool 240 as indicated in FIGS. 10, 11, and 13.

In operation, power recovery rotor 250 is driven at an idling speed of 1586 r.p.m. by timing belt 258 so that the tangential velocity of rotor inlets 308 is approximately forty-five percent of the tangential velocity of pool surface 242. As indicated in FIG. 13, channel inlet ports 308 skim liquid substantially tangentially from pool surface 242, which liquid flows radially inwardly of channel members 306 (as indicated by arrows 316) and transfers energy to power recovery rotor 250 (as described above in connection with FIGS. 1B and D, and that power is fed back via rotor assembly pulley 256 and drive belt 258 to the drive system rotor shaft 108. The skimmed liquid flows from ports 310 into collection compartment 238 for discharge from the bottom of casing 12 through piping connections (not shown).

Figure 15:
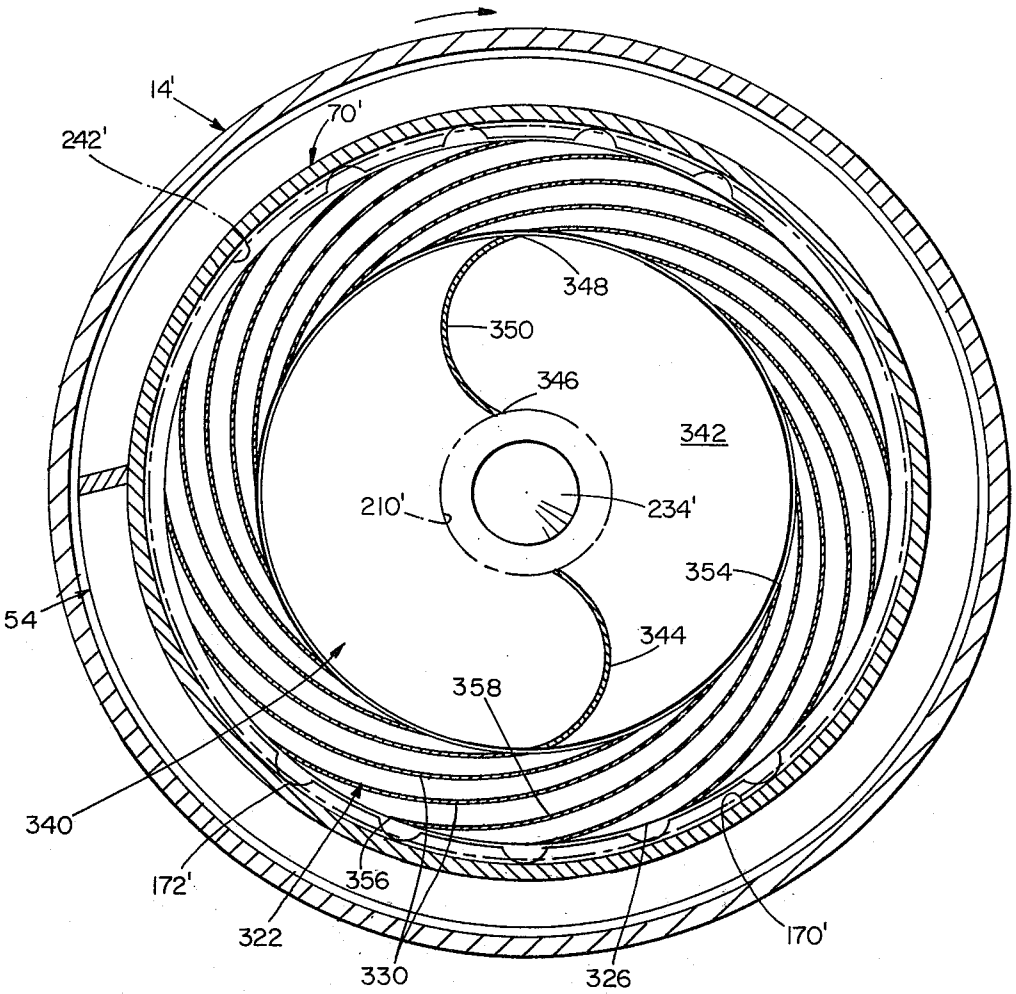
FIG. 15 is a sectional view taken along the line 15–15 of FIG. 14.
Figure 14:
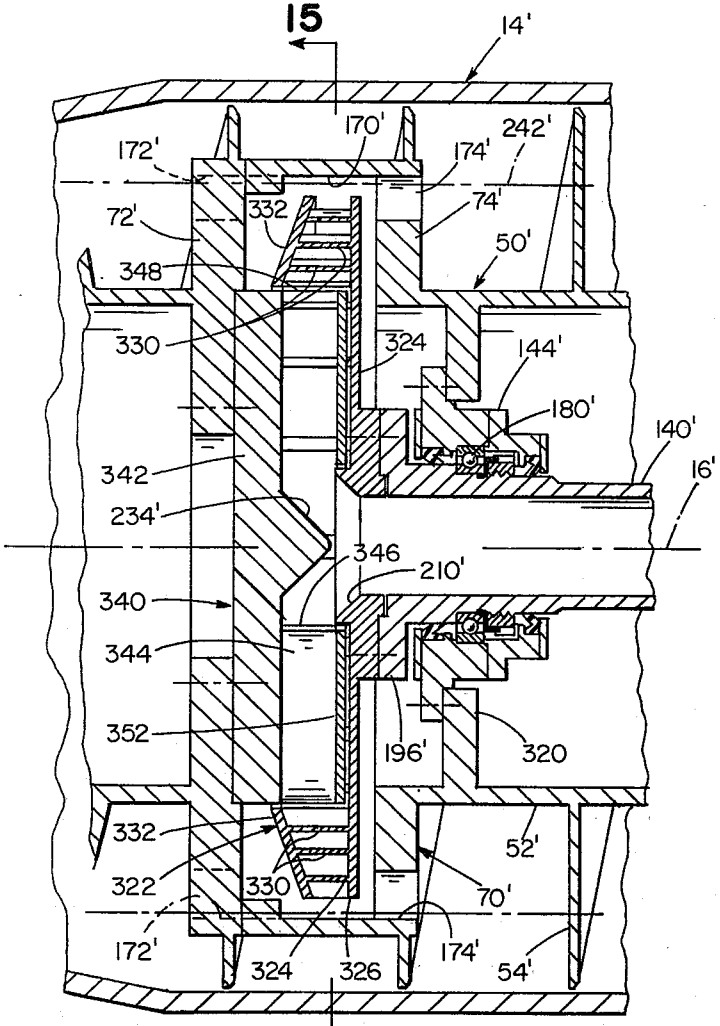
FIG. 14 is a sectional view, similar to FIG. 6 of another feed acceleration system suitable for use in a centrifuge of the type shown in FIGS. 2 and 3.

Another feed acceleration system suitable for use in a centrifuge of the type shown in FIGS. 2 and 3 is shown in FIGS. 14 and 15. Feed accelerator chamber 70' has similar opposed radial extending walls 72', 74' and annular surface 170' that has an inner diameter of about twenty inches. A circumferential array of discharge ports 172', 174' is formed in each chamber wall. Bearing housing 144' is secured to flange 320 of conveyor hub and houses ball bearing assembly 180' and associated seals. Feed pipe 140', stationary in this embodiment, has a flange 196' to which is bolted feed accelerator stator assembly 322 that includes an annular base plate 324 with a peripheral surface 326 that is spaced about one-half inch from accelerator chamber surface 170'. Welded to base plate 324 is an array of sixteen stator vanes 330 and an enclosing shroud disc 332.

Bolted to accelerator chamber wall 72' is a feed accelerator rotor assembly 340 that includes base disc 342 with an integral deflector cone 234'. Upstanding from base disc 342 are two acceleration vanes 344, each of which has an entrance edge 346 that merges with inlet surface 210', a discharge edge 348 at the periphery of rotor disc 342, and a smoothly curved surface 350 that has an angular extent of about 150 degrees. Plate 352 is welded to the upper edge of vanes 344 and extends parallel to the surface of disc 342 to provide with vanes 344 enclosed channel members on the rotor. Each stator vane 330 has an inlet edge 354 at the inner periphery of the stator, a discharge edge 356 at the outer periphery of the stator, and a smoothly curved surface 358 as an extension of rotor vanes 344 that has an angular extent of about 90 degrees.

Figure 16:
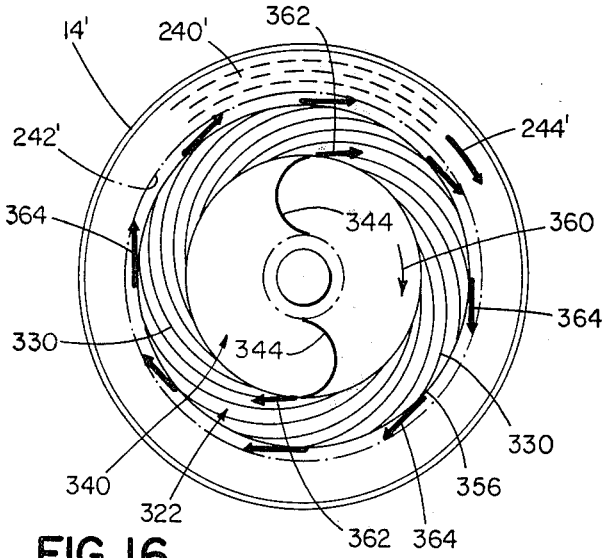
FIG. 16 is a diagrammatic view illustrating operation of the power exchange feed accelerator arrangement shown in FIGS. 14 and 15.
Figure 20:
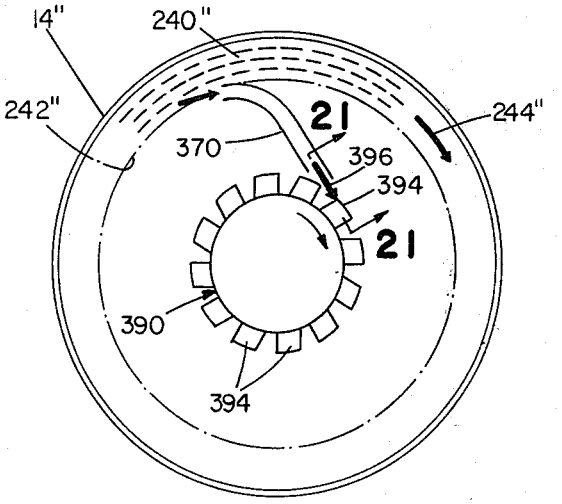
FIG. 20 is a diagrammatic view illustrating operation of the power recovery system shown in FIGS. 17 and 18.

Operation of this feed accelerator arrangement is similar to the feed accelerator shown in FIGS. 6 and 7. Bowl 14' is driven in rotation at 3500 r.p.m. The slurry to be separated is fed through nonrotating feed pipe 140' through entrance passage 210' for deflection radially outward by surface 234' into the vanes of the acceleration rotor 340. As rotor 340 is fixed to conveyor hub 52, it is rotating in the same direction and at substantially the same rate as bowl 14 (about 3490 r.p.m.) as indicated by arrow 360 (FIG. 16). The feed slurry is accelerated by vanes 344 about the axis of curvature of the vanes to a higher velocity (as indicated by vectors 362) than th peripheral velocity of the rotor and is discharged for flow through the passages between stator vanes 330 and discharge from stator vane tips 356 essentially tangentially to pool surface 242' (as indicated at 364). The diameter of acceleration rotor 340 and the shape of its vanes 344 are proportioned with the rotational speed of the conveyor to which it is attached such that the velocity of discharge of the slurry from the rotor is substantially equal to the velocity of the treating zone defined by pool surface 242', or preferably to exceed such pool surface velocity sufficiently to offset friction losses in the stator. Thus the slurry enters surface 242' substantially tangentially, and at the same velocity and integrates smoothly into pool 240' with minimal turbulence, as indicated diagrammatically by arrows 364 in FIG. 16. Power saving occurs in the rotor due to the slurry acceleration and discharge substantially tangential to and at a velocity equal to the velocity of the pool surface.

Figure 19:
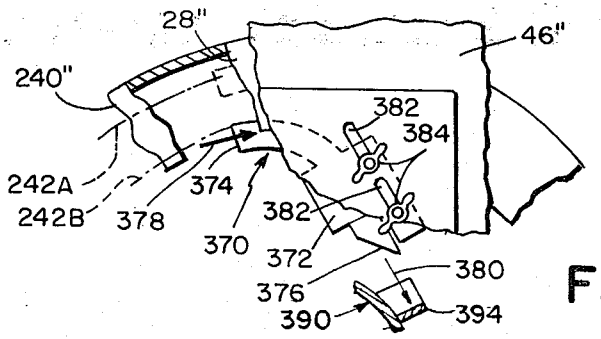
FIG. 19 is an elevational view taken along the view 19—19 of FIG. 17, showing aspects of the skimmer channel support and adjustment arrangement.
Figure 18:
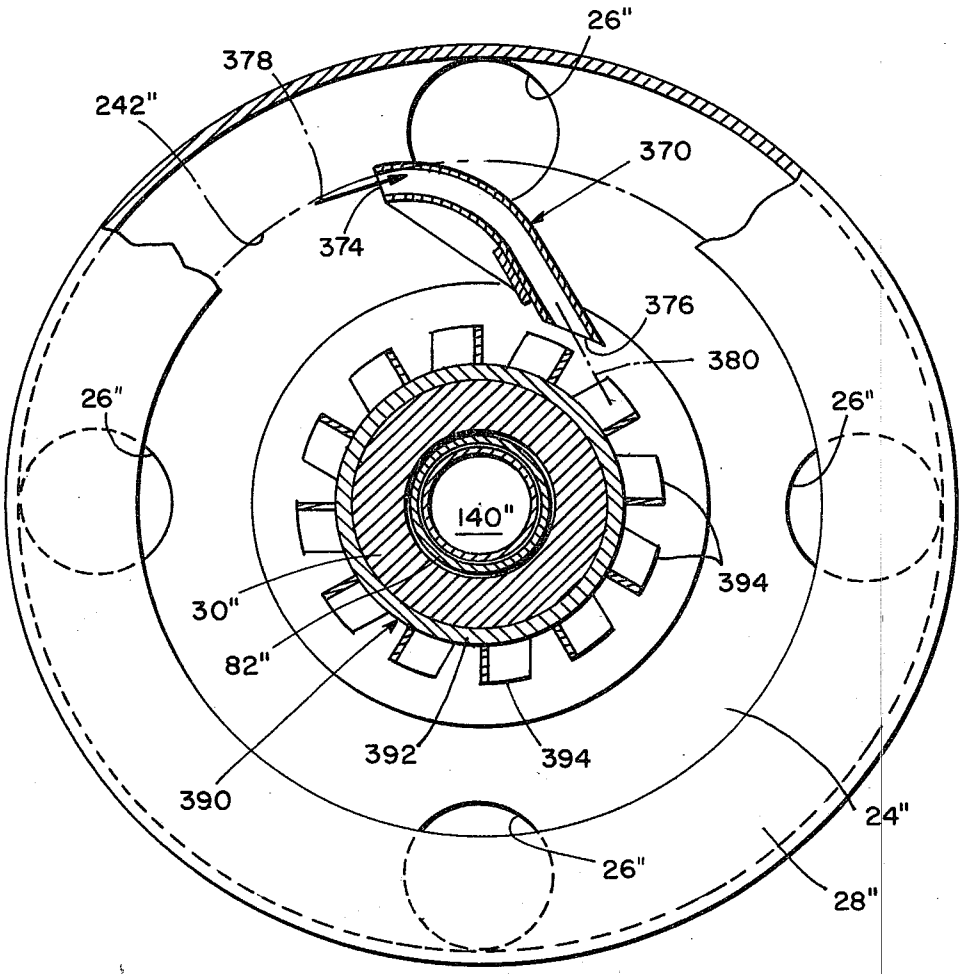
FIG. 18 is a sectional view taken along the line 18—18 of FIG. 17.
Figure 17:
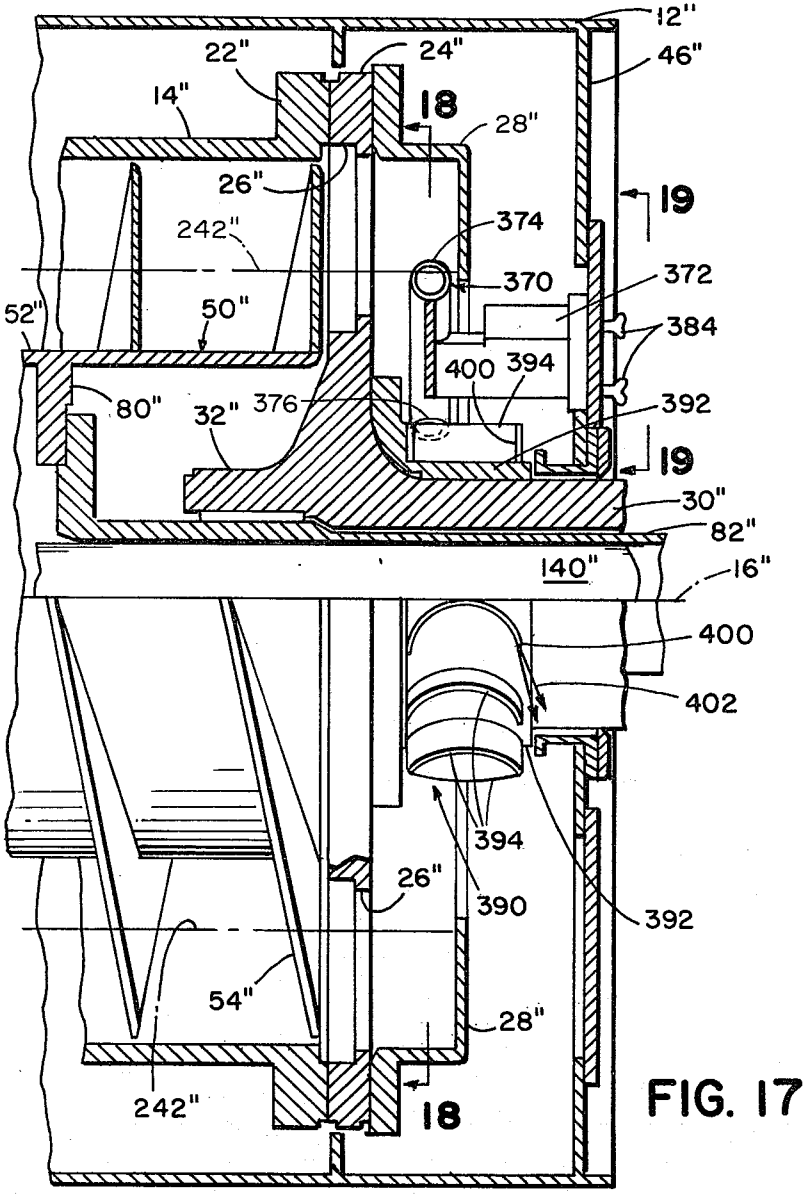
FIG. 17 is a sectional view, similar to FIG. 10, of another embodiment of an energy conservation power recovery system.

Shown in FIGS. 17 and 18 is another embodiment of a power recovery system for disposition at the liquid end of centrifuge bowl 14''. That power recovery system includes a skimmer conduit 370 that is secured to end wall 46'' of housing 12'' by mounting bracket 372. Skimmer conduit 370 has an entrance port 374 disposed normal to pool surface 242'' and a discharge port 376. The inlet axis 378 of skimmer 370 is tangential to the surface 242'' of centrifuge pool 240 and its discharge axis 380 is disposed at an angle of about 135 degrees to inlet axis 378. As indicated in FIG. 19, end wall 46'' has slots 382 (parallel to discharge axis 380) in which studs of mounting bracket 372 of skimmer conduit 370 are secured by nuts 384 such that conduit 370 is adjustable along a path parallel to discharge axis 380 permitting the location of inlet port 374 relative to the surface of pond 240'' to be adjusted between a minimal pool depth 242A of about one inch and a maximum pool depth 242B of about $2\frac{1}{4}$ inches.

Figure 21:
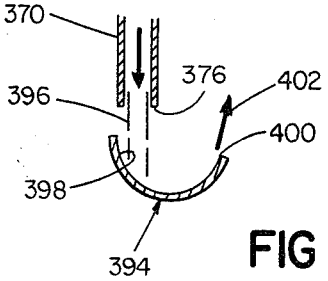
FIG. 21 is a diagrammatic view taken along the line 21—21 of FIG. 20.

Power recovery rotor 390 is fixed to bowl shaft 30'' for rotation therewith and includes a hub 392 on which an array of twelve radially extending bucket blades 394 are mounted. Each bucket blade has an angular extent of about 170 degrees as indicated in FIG. 21, and is contoured and arranged relative to the liquid discharge axis 380 of skimmer 370 so that the jet stream 396 of pool liquid skimmed by conduit 370 impinges on the inner portion 398 of each bucket blade 394 substantially tangentially to its path of rotation, and flows across the blade for discharge from the outer edge 400, along paths generally indicated by arrow 402, in a direction outwardly of gutter 28'' into collection compartment 238.

In this power recovery arrangement, liquid from pool surface 242'' is directed radially inward by skimmer 370 for impingement on bucket blades 394 which are fixed to bowl 14'' and that impinging action transfers energy to drive centrifuge bowl 14" directly and thus recovers power from the liquid being discharged from pool 240". The diameter of the circular path of revolution of the ends of blades 394 is somewhat less than half the diameter of the pool surface 242", so that the blades 394 are rotated at less than half the surface velocity of the pool. Thus, liquid from the pool striking the blades at a high tangential velocity, nearly equal to the velocity of pool surface 242", applies driving force to rotor 390.

While particular embodiments of the invention have been shown and described, various modifications will be apparent to those skilled in the art and therefore it is not intended that the invention be limited to the disclosed embodiments or to details thereof, and departures may be made therefrom within the spirit and scope of the invention.

What is claimed is:

1. In a centrifuge having a bowl with an annular treating zone within the outer portion of said bowl, means for rotating said bowl about an axis for forming material within said zone into an annular pool to subject material in said pool to centrifugal force treatment, feed means for supplying material flowable as a liquid to be treated to said annular treating zone, and discharge means for discharging material flowable as a liquid from said treating zone and said bowl while said bowl is rotating, the improvement for conserving energy wherein at least one of said feed means and said discharge means comprises:

a power exchange rotor mounted for rotation about an axis and provided with at least one material flow direction changing channel member spaced from the rotor axis less than the maximum radius of said bowl in the area of said treating zone, said channel member constructed and arranged to guide flow of material therethrough from an inlet end to a discharge end while changing the direction of flow of said material therein at least about 90 degrees in a manner to effect energy transfer from one of said material and rotor to the other with at least about 70 percent efficiency, transfer means arranged to direct transfer of material between said annular pool in said treatment zone and one end of said channel member, along a path which is substantially tangential to the surface of said annular pool at its interface therewith and substantially tangential to the path of rotation of said channel member end at its interface therewith, while maintaining the kinetic energy of the material being transferred substantially unchanged; and power means connected to said rotor for translating said energy transfer into power saving.

2. The centrifuge of claim 1 wherein said rotor has a smaller diameter than the inner surface of said zone.

3. The centrifuge of claim 1 wherein said rotor is mounted for rotation about the bowl axis in the same direction as said bowl.

4. The centrifuge of claim 1 for separating solids from liquid of the material which includes at least one outlet for discharging the separated solids, conveyor mechanism in said bowl and means for rotating said conveyor mechanism about said bowl axis for causing movement of said separated solids longitudinally of the bowl axis to said outlet.

5. The centrifuge of claim 4 wherein said rotor is in said feed means and has a diameter substantially less than the inner surface of said zone, said transfer means comprises an array of fixed stator vanes surrounding said rotor and extending between said rotor and the inner surface of said zone, and means are provided for rotating said rotor comprising said conveyor mechanism and an attachment of said rotor thereto to rotate therewith.

6. The centrifuge of claim 4 wherein said rotor is in said feed means, has a diameter slightly less than said zone inner surface and comprises said transfer means, and means are provided for rotating said rotor at a lower angular velocity than the angular velocity of said conveyor mechanism.

7. The centrifuge of any of claims 1 to 4 wherein said feed means comprises a said rotor constructed and arranged to receive the material adjacent its said axis and to move it outwardly to a channel discharge end of said rotor while accelerating the material so that it will discharge from said channel discharge end at a velocity at least about 1.4 times the peripheral velocity of said rotor, and said power means includes drive means for rotating said rotor at a rate reduced by said energy transfer.

8. The centrifuge of claim 7 wherein said rotor comprises a plurality of said channel members in the form of curved channels for radially outward flow of the material therein.

9. The centrifuge of any of claims 1 to 4 wherein said discharge means comprises a said rotor constructed and arranged to receive the material adjacent its periphery and to move it to a channel discharge end of said rotor while decelerating the material so that it will discharge from said channel discharge end at a velocity which is small compared to the tangential velocity of the pool surface, and said power means includes means connected to said rotor for deriving power from rotational force applied to said rotor by said energy transfer.

10. The centrifuge of claim 9 wherein said rotor comprises a plurality of said channel members in the form of curved channels for radially inward flow of the material therein.

11. The centrifuge of claim 9 wherein said rotor has a plurality of channel members provided with discharge ends closer to said rotor axis than said inlet ends.

12. The centrifuge of claim 9 wherein said rotor has a plurality of channel members provided with inlet ends that are at substantially the same radial distance from said rotor axis as said discharge ends.

13. The centrifuge of claim 9 wherein said discharge means includes means for continuously discharging from the bowl an essentially liquid fraction of the material treated in the bowl comprising said rotor and said power means includes means connecting said rotor in power applying relation to said bowl rotating means.

14. The centrifuge of claim 13 wherein said transfer means is arranged to dip into an annular layer of material which is rotating with the bowl at approximately the same angular velocity as material in said zone.

15. The centrifuge of claim 14 wherein said transfer means also includes gutter structure at one end of said treating zone for presenting an annular layer of said liquid fraction to said channel member inlet end.

16. The centrifuge of either of claims 14 or 15 for separating solids from liquid of the material which includes at least one outlet for discharging the separated solids, and conveyor mechanism in said bowl rotatable about said axis for causing movement of said separated solids longitudinally of the bowl axis to said outlet, and wherein said rotor and said bowl are coaxial.

17. The centrifuge of claim 16 wherein said rotor is fixedly attached to said bowl and said transfer means includes a non-rotating stator including at least one scoop constructed and arranged to dip at its inlet end into said annular layer to scoop material substantially tangentially from said layer and to discharge said material from the opposite end thereof substantially tangentially into said rotor channel member inlet end.

18. The centrifuge of any of claims 1 to 4 further including drive means for rotating said rotor at a rate such that the velocity of said rotor channel member is substantially less than the velocity of said zone.

19. The centrifuge of any of claims 1 to 4 wherein said rotor comprises said transfer means.

20. The centrifuge of claim 19 wherein said transfer means comprises said one end of said channel member.

21. The centrifuge of any of claims 1 to 4 wherein said rotor has a diameter substantially less than the inner surface of said zone and said transfer means comprises fixed stator structure extending between said rotor and said zone.

22. The centrifuge of claim 21 wherein said stator structure has a plurality of vanes that define curved flow passages extending between the periphery of said rotor and the surface of said annular pool.

23. The centrifuge of claim 21 wherein said stator structure is in the form of a tubular member extending between the surface of said annular pool and the periphery of said rotor.

24. The centrifuge of claim 1 wherein said discharge means includes a said power exchange rotor at one end of said treating zone, said transfer means is arranged to dip into an essentially liquid fraction of the material in said annular layer, and said power means includes means connected to said discharge means rotor in power applying relation to said bowl rotating means.

25. The centrifuge of claim 1 for separating solids from the supplied material which includes at least one outlet for discharging the separated solids, conveyor mechanism in said bowl rotatable about said bowl axis for causing movement of said separated solids longitudinally of the bowl axis of said outlet, said conveyor mechanism comprising at least one conveyor blade extending helically about said axis, and means for rotating said blade about said axis at a differential rate of rotation to that of said bowl for causing said movement of the separated solids, and wherein said feed means includes a said power exchange rotor and a feed pipe that has a discharge outlet on the axis of said bowl, said feed means rotor having an inlet for receiving material discharged from said feed pipe outlet and a plurality of channel members extending radially outwardly from said inlet, said feed means rotor being disposed in a rotor housing fixed to said conveyor, said rotor housing having its periphery disposed in said annular treating zone and having ports for flow of material from said housing into said annular pool.

26. The centrifuge of claim 25 wherein said rotor housing is located intermediate the ends of said bowl, and said feed pipe extends coaxially through said bowl to said rotor housing.

27. The centrifuge of claim 24 for separating solids from the supplied material which includes at least one outlet for discharging the separated solids, conveyor mechanism in said bowl rotatable about said bowl axis for causing movement of said separated solids longitudinally of the bowl axis to said outlet, said conveyor mechanism comprising at least one conveyor blade extending helically about said axis, and means for rotating said blade about said axis at a differential rate of rotation to that of said bowl for causing said movement of the separated solids, and wherein said feed means includes a said power exchange rotor and a feed pipe that has a discharge outlet on the axis of said bowl, said rotor having an inlet for receiving material discharged from said feed pipe outlet and a plurality of channel members extending radially outwardly from said inlet, said rotor being disposed in a rotor housing fixed to said conveyor, said rotor housing having its periphery disposed in said annular treating zone and having ports for flow of material from said housing into said annular pool.

28. The centrifuge of either claim 24 or 25 wherein said rotor is mounted for rotation about the same axis as said bowl and the periphery of said rotor is immediately adjacent the inner surface of said annular treating zone.

29. The centrifuge of either claim 24 or 25 wherein said rotor is mounted for rotation about the same axis and at essentially the same speed as said bowl, and the periphery of said rotor has a diameter substantially smaller than the diameter of the inner surface of said annular treating zone.

30. The centrifuge of either claim 24 or 25 wherein said channel member has a smooth surface that is curved about an axis parallel to the rotor axis.

31. The centrifuge of claim 30 wherein said channel member further includes radially extending bounding surfaces disposed on either side of said smooth surface.

32. The centrifuge of claim 24 wherein said channel member has a smooth surface that is curved about an axis perpendicular to the rotor axis.

33. The centrifuge of claim 24 wherein said channel member is of tubular configuration.

34. The centrifuge of claim 1 wherein each of said feed means and said discharge means includes a said power exchange rotor.

35. The centrifuge of any of claims 9, 24, 32, and 33 further including means to adjust the radial position of the interface of said transfer means and the surface of said annular pool.

36. In a method of treating a material flowable as a liquid in a centrifuge which includes the steps of feeding the material to a centrifuge bowl rotating about an axis so that the material forms an annular pool in a treating zone in the outer portion of the bowl where it is subjected to centrifugal force treatment, and of discharging treated material flowable as a liquid from said bowl, the steps for conserving energy by power exchange which include, in at least one of said feeding and discharging steps:

causing said material to flow through at least one channel of a rotor rotating about an axis at a rate such that the velocity of each end of said channel is substantially less than the velocity of the material in said treatment zone at the surface of said pool, and while the material is spaced from the rotor axis less than the maximum radius of the bowl in said treating zone;

in said channel changing the direction of flow of said material at least 90 degrees in a manner to effect energy transfer from one of said material and rotor to the other with at least about 70 percent efficiency;

transferring the material between said rotor and said pool in at least one stream which is substantially tangential to the surface of said pool at its interface therewith and substantially tangential to the path of rotation of an end of said channel at its interface therewith, and while maintaining the kinetic energy of the material being transferred substantially unchanged; and translating said energy transfer into power saving.

37. A method according to claim 36 wherein said rotor is rotated about the bowl axis in the same direction as said bowl.

38. A method according to claim 36 wherein in said feeding step said material is discharged from said rotor at a velocity at least about 1.4 times the peripheral velocity of said rotor.

39. A method according to claim 36 wherein in said discharging step said material is discharged from said rotor at a velocity which is small compared to the tangential velocity of the pool surface.

40. A method according to claim 39 wherein said material passes from said zone to a gutter rotating at the angular velocity of said zone and is supplied to said channel from said gutter.

41. A method according to claim 36 wherein said material is caused by said channel to flow in a path generally curved about a center located between the axis of rotation of said rotor and the outer end of said channel.

42. A method according to any of claims 36 through 40 wherein said rotor is coaxial with said bowl.

43. A method according to claim 42 wherein said energy transfer is applied directly to reduce the power required to rotate said bowl by fixing said rotor to said bowl with the inlet of said channel spaced from the bowl axis less than half the radius of the bowl.

* * * * *

UNITED STATES PATENT AND TRADEMARK OFFICE

CERTIFICATE OF CORRECTION

PATENT NO. : 4,334,647

DATED : June 15, 1982

INVENTOR(S) : Edward S. Taylor

It is certified that error appears in the above-identified patent and that said Letters Patent are hereby corrected as shown below:

Column 2, line 25, "in" should be --with--.

Signed and Sealed this

Tenth Day of August 1982

[SEAL]

Attest:

GERALD J. MOSSINGHOFF

Attesting Officer

Commissioner of Patents and Trademarks